US006222139B1

(12) United States Patent
Pandit et al.

(10) Patent No.: US 6,222,139 B1
(45) Date of Patent: Apr. 24, 2001

(54) ROTARY ELECTRIC SWITCH AND CONTACT THEREFORE

(75) Inventors: Anilkumar D. Pandit; M. Natarajan; A. Ramadevi, all of Bangalore; Rajesh Pandey, Delhi; G. Easwaran, Chennai; Dileep Mangsuli, Bangalore, all of (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/396,380

(22) Filed: Sep. 15, 1999

(51) Int. Cl.[7] ..... H01H 19/58
(52) U.S. Cl. ..... 200/11 A
(58) Field of Search ..... 200/570, 571, 200/564, 244

(56) References Cited

U.S. PATENT DOCUMENTS

| | | | | |
|---|---|---|---|---|
| 864,261 | * | 8/1907 | Ringwood . | |
| 1,370,028 | * | 3/1921 | Lum . | |
| 1,610,676 | * | 12/1926 | Hart . | |
| 2,045,417 | * | 6/1936 | Siegel | 200/63 |
| 2,335,388 | * | 11/1943 | Conradty et al. | 200/153 |
| 3,632,935 | | 1/1972 | Stegmaler . | |
| 3,917,920 | | 11/1975 | Pekrul et al. . | |
| 4,778,959 | | 10/1988 | Sabatella et al. . | |
| 4,910,485 | * | 3/1990 | Bolongeat-Mobleu et al. | 335/195 |
| 5,290,980 | | 3/1994 | Cummings . | |

OTHER PUBLICATIONS

Holec; 4 pages, Product brochure No date.
Santon: 2 pages, Products brochure No date.

* cited by examiner

*Primary Examiner*—Michael L. Gellner
*Assistant Examiner*—Nhung Nguyen
(74) *Attorney, Agent, or Firm*—Nixon Peabody LLP; Robert M. Schulman; Carl B. Horton

(57) ABSTRACT

An electric switch having fixed contacts and rotary movable contacts in pairs. The movable contact have a central portion coupled to a rotary member and end portions adapted to contact the fixed contacts. The end portions extend from the central portion at an angle. The movable contact pairs lie in substantially the same plane.

54 Claims, 5 Drawing Sheets

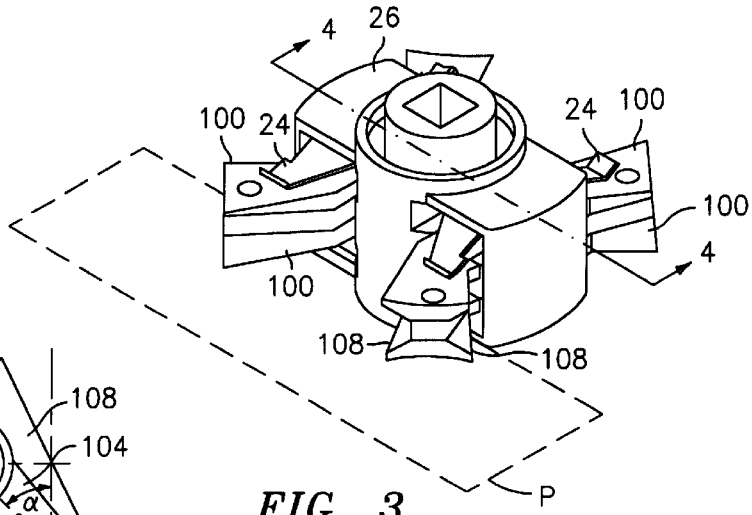
FIG. 3
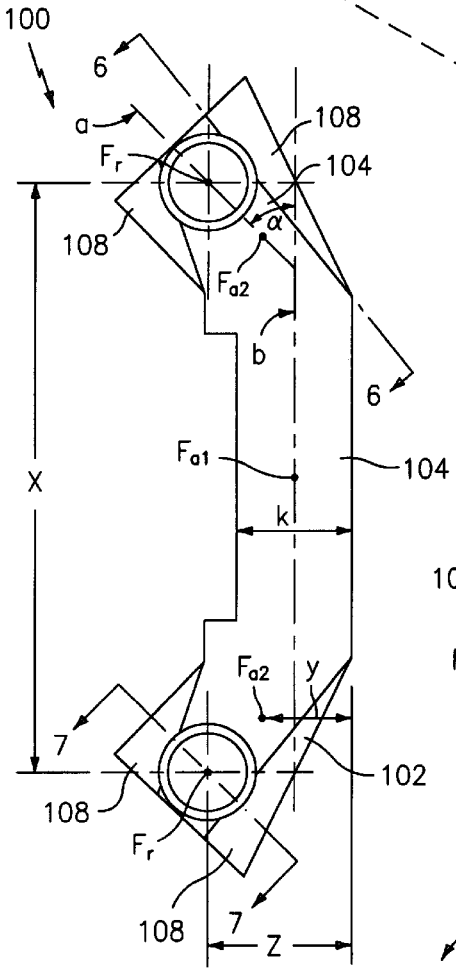
FIG. 5
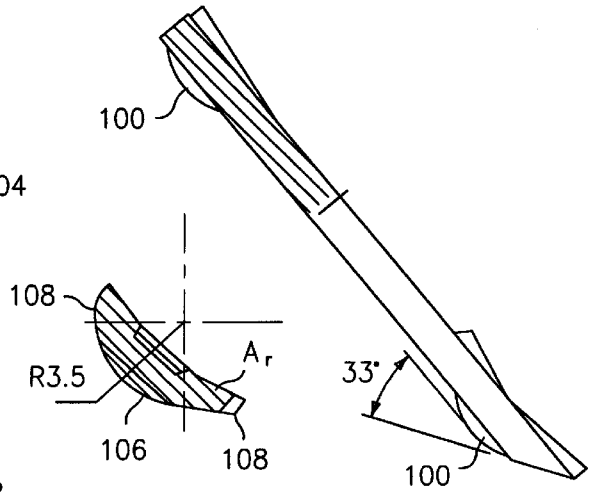
FIG. 6
FIG. 7
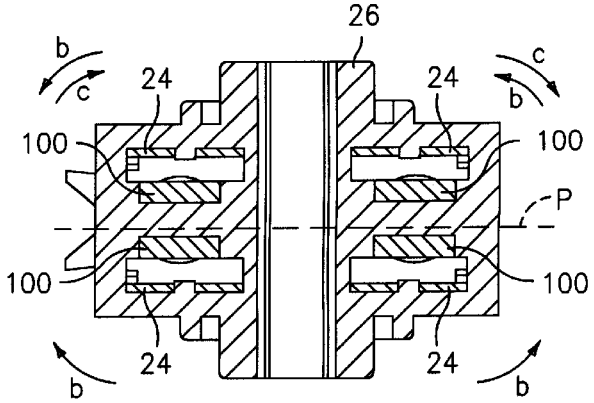
FIG. 4

ROTARY ELECTRIC SWITCH AND CONTACT THEREFORE

BACKGROUND OF THE INVENTION

The invention relates to an electric switch and more particularly to a four-break electric switch having two pairs of rotatably movable contacts and four fixed contacts and a contact suitable for use in such a switch.

Manually operated electric switches having ratings of up to several hundred amps are well known. Some such switches include an integral fuse element. Typically, the load contact, i.e. fixed contact, in such a switch is selectively engaged and disengaged by a movable blade, i.e. movable contact, that is cantilever supported in spaced relation to the fixed contact. Of course, to withstand high currents and effectively break the high currents, the contacts and the space in which the movable contacts move must be relatively large. To reduce the size of electric switches, it has been proposed to mount movable contacts to rotate about a central portion thereof to accomplish two breaks with two fixed contacts (one break at each end of the movable contact) in about the same space as one break is accomplished in the cantilever type of contact mounting. The word "break" as used herein refers to a location at which movable contacts can be selectively placed in contact with a fixed contact or other movable contacts to "make" or "break" current. Of course, the use of two breaks increases the effective contact area, i.e. the area in which the fixed contact touches the moving contact and thus increases switching capacity. U.S. Pat. No. 3,632,935 is representative of patents disclosing a two-break contact rotatable about a center thereof.

Further the use of movable contacts in pairs is well known. As disclosed in U.S. Pat. No. 3,632,935, the use of parallel movable contacts in combination with a single fixed blade or contact generates electro-motive force (EMF) that tends to pull the movable contacts towards one another (a force of attraction) and overcome the tendency of a movable contact to repel a fixed contact (a force of repulsion). In particular, the current flowing through the point of contact between fixed and movable contacts generates a force of repulsion at that point (technically known as "Crowding Effect"). Also, the entire current carrying area of a pair of movable contacts generates a force of attraction therebetween that can be used to overcome the force of repulsion to thereby avoid "popping", i.e. separation of the contacts due to EMF which results in damage to the contacts and failure of the switch. However, it is difficult to implement pairs of contacts that are rotatable about a central portion in rotary switches having more than two breaks. In particular, in order to mount plural contact pairs (which are required for more than two breaks) on the same rotating member, it is necessary to offset the contact pairs to be in different planes to avoid mechanical interference between the contact pairs and to avoid electrical communication between the contact pairs. This increases the required dimensions of the switch.

The "S" Type Fused Combination Switches" sold by MEM SANTON SWITCHGEAR implements a four break rotary switch in a relatively small package by using four single knife contacts on a rotating member and fixed U shaped contacts having two extending portions on respective sides of the knife contacts disposed around the rotating member. However, the relatively small dimensions of the extending portions are not adequate to generate the high attractive forces necessary to avoid popping at high currents. Further, the size and configuration of the fixed contacts does not permit the extending portions to be easily flexed towards each other and thus even if a high force of attraction was generated, the contacts would not "grip" the movable contact and thus are not as stable as true contact pairs. Extending the size of the fixed contacts would increase the size of the device.

The complex interaction between mechanical and electrical forces in a rotary switch have rendered it difficult to implement four breaks in a compact design. Also, known four break rotary switches have relatively unstable contacts or are unduly large.

SUMMARY OF THE INVENTION

A first aspect of the invention is an electric switch comprising housing, four contacts mounted to the housing, a rotary member rotatably mounted with respect to the housing, and two pairs of movable contacts. Each movable contact has a central portion coupled to the rotary member and end portions adapted to contact a corresponding one of the contacts. The pairs of movable contacts are mounted in substantially the same plane.

A second aspect of the invention is an electric switch comprising a housing, four contacts mounted to the housing, a rotary member rotatably mounted with respect to the housing, and two pairs of movable contacts. Each movable contact has a central portion coupled to the rotary member and end portions adapted to contact a corresponding one of the contacts. A longitudinal axis of the end portions extend at an angle with respect to a longitudinal axis of the central portion and the end portions are in substantially the same plane as the central portion.

A third aspect of the invention is a movable contact for an electric switch of the type having fixed contacts, a rotary member, and at least one pair of the movable contacts mounted on the rotary member. The movable contacts each comprises a central portion adapted to be coupled to the rotary member and end portions adapted to define breaks with a corresponding one of the fixed contacts. A longitudinal axis of the end portions extend at an angle with respect to a longitudinal axis of the central portion and the end portions are in substantially the same plane as the central portion.

BRIEF DESCRIPTION OF THE DRAWING

The invention is described through a preferred embodiment and the attached drawing in which:

FIG. 3 is a perspective view of the contact carrier and movable contacts of the preferred embodiment;

FIG. 4 is a sectional view taken along line 4—4 in FIG. 3;

FIG. 5 is a top view of a movable contact of the preferred embodiment;

FIG. 6 is a sectional view taken along line 6—6 in FIG. 5;

FIG. 7 is a sectional view taken along line 7—7 in FIG. 5;

DETAILED DESCRIPTION OF THE PREFERRED EMBODIMENT

Figure 1:
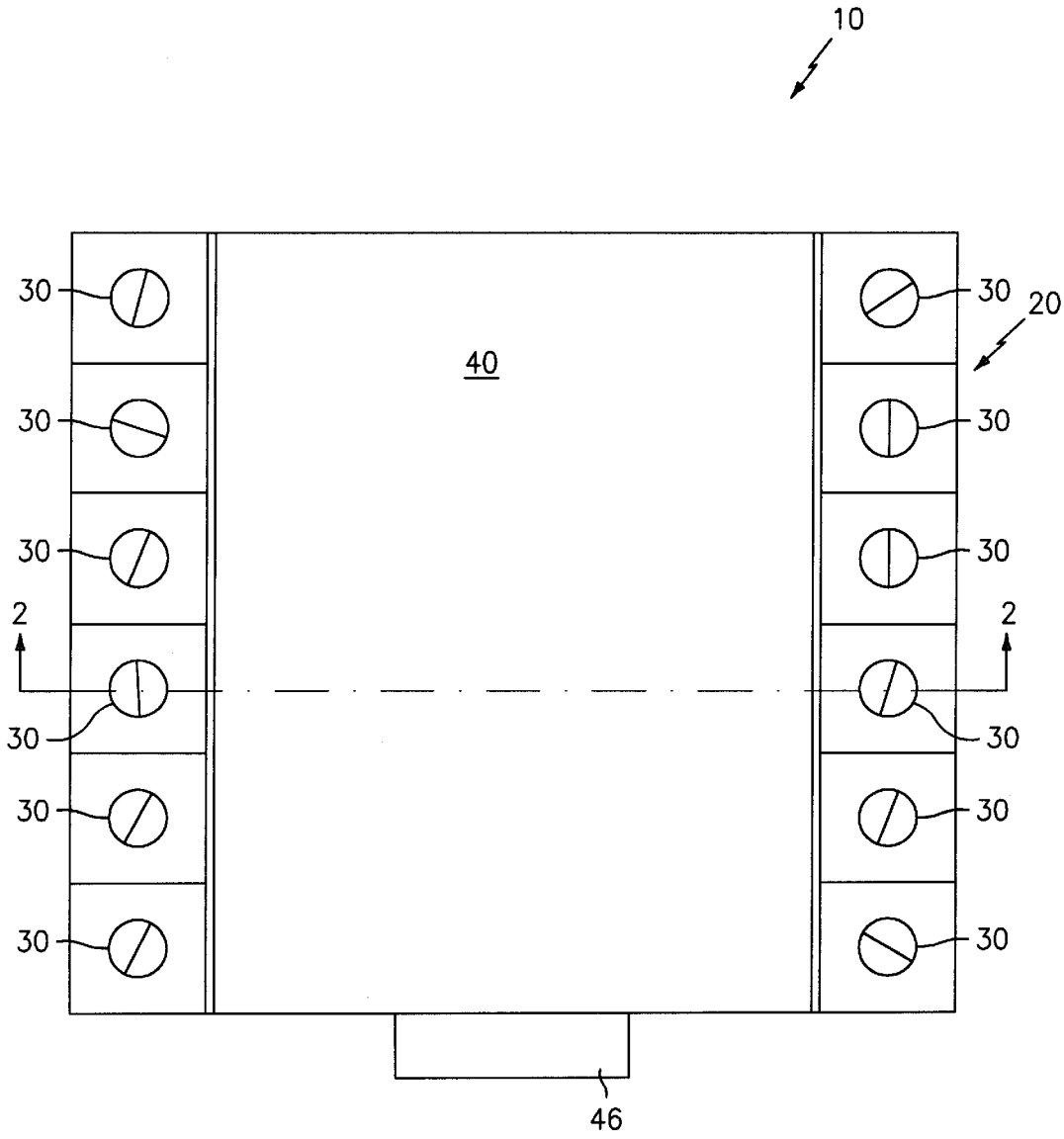
FIG. 1 is a top view of a switch in accordance with a preferred embodiment of the invention.
Figure 2:
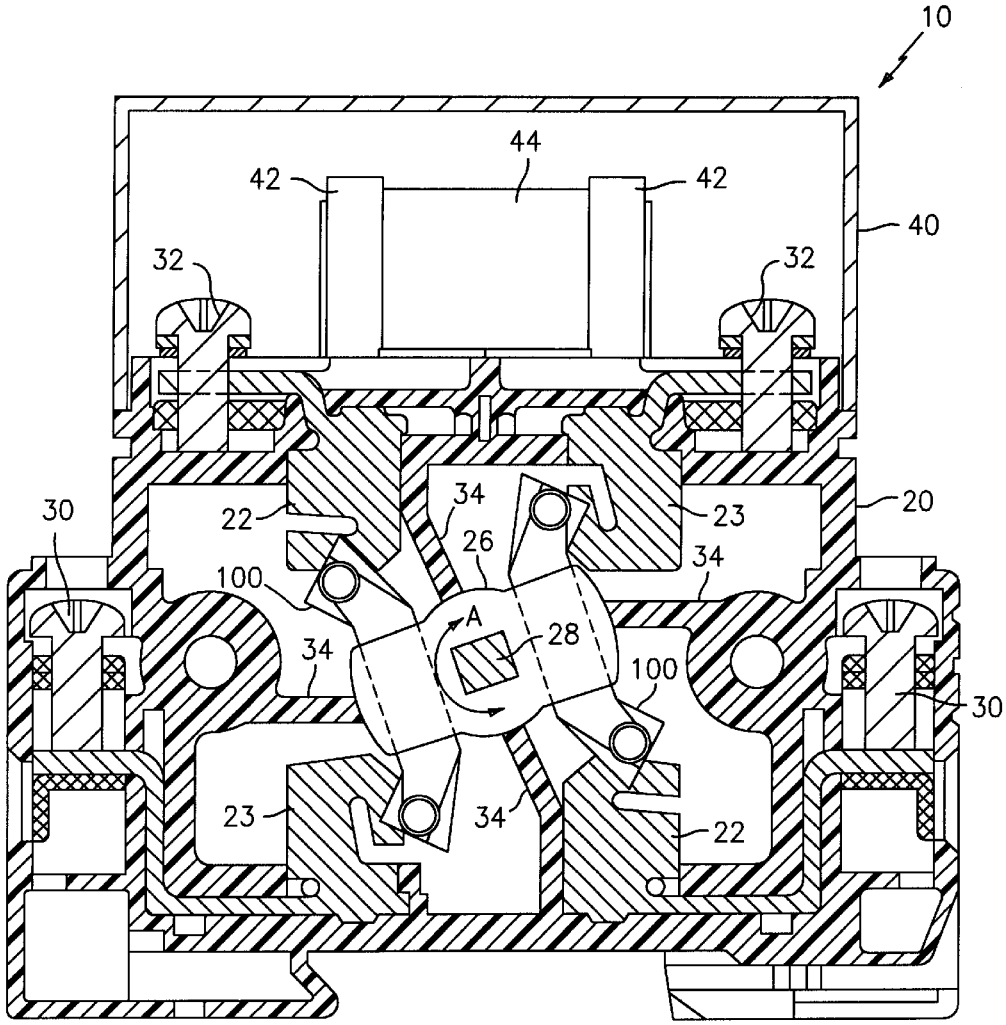
FIG. 2 is a sectional view taken along line 2—2 in FIG. 1 with the movable contacts beginning to contact the fixed contacts.

As illustrated in FIG. 1, switch 10 includes housing 20, preferably made of a synthetic resin material or other electrically insulated material, removable cover 40, and rotatable handle 46. In the preferred embodiment, housing 20 substantially surrounds the other components disclosed below. However, housing 20 can take any form in which the other components are mounted thereto. For example, housing 20 can be in the form of a base plate. As illustrated in FIG. 2, two fixed contacts 22 and two fixed contacts 23 are fixedly disposed in housing 20. Fixed contacts 22 and 23 of the preferred embodiment are essentially plate-like members and lie in substantially the same plane as described in greater detail below. A rotary member comprises shaft 28 coupled to handle 46 and contact holder 26 made of a material that has electric and thermal insulation properties as described in greater detail below. Two pairs of movable contacts 100 are mounted in contact holder 26 to rotate in the directions indicated by double-headed arrow A about an axis of shaft 28 when shaft 28 is rotated by rotating handle 46.

It can be seen that rotation of handle 46, and thus the rotary member comprised of shaft 28 and contact carrier 26, in the clockwise direction in FIG. 2 causes end portions 102 (see FIG. 5) of movable contacts 100 to move towards corresponding fixed contacts 22 and 23. Similarly, rotation of handle 46, and thus the rotary member comprised of shaft 28 and contact carrier 26, in the counter-clockwise direction in FIG. 2 causes end portions 102 of movable contacts 100 to move away from corresponding fixed contacts 22 and 23. The position of movable contacts 100 illustrated in FIG. 2 corresponds to a position in which movable contacts 100 just begin to contact corresponding fixed contacts 22 and 23 as shaft 28 is rotated in the clockwise direction. It can be seen that each end portion 102 begins to contact fixed contacts 22 and 23 at the same time during rotation of handle 46. Also, it can be seen that switch 100 defines four breaks corresponding to each of four pairs of end portions 102. One fixed contact 22 and one fixed contact 23 are electrically coupled to terminals 32 to which fuse clips 42 are electrically coupled. Accordingly, fuse element 44, such as a standard fast acting or slow blow thermal fuse, can be connected between two fixed contacts 22 and 23.

Cover 40 serves to isolate and protect fuse element 44 and is optional. For example fuse element 44 can be exposed or fuse element 44 can be omitted and terminals 32 can be electrically coupled in a direct manner to provide an unfused switch. The other fixed contacts 22 and 23 are electrically coupled to terminals 30 to which incoming (line) and outgoing (load) can be connected in a known manner. The line and load terminals are interchangeable in the preferred embodiment. One set of movable contacts 100 and fixed contacts 22 and 23, i.e. two pairs of movable contacts 100, two fixed contacts 22, and two fixed contacts 23, are illustrated in FIG. 2. However, the invention can include plural sets of fixed contacts 22 and 23 and plural sets of movable contacts 100 mounted on a single shaft 28. The preferred embodiment has six such sets as indicated in FIG. 1 by six sets of load terminals 30.

As illustrated in FIGS. 3 and 4, movable contacts 100 are supported in contact carrier 26 as two opposing pairs of parallel contacts 100 extending through respective openings in contact carrier 26. Springs 24, in the form of a leaf spring in the preferred embodiment, are disposed in contact carrier 26, as illustrated, to press movable contacts 100 into a seat defined in carrier 26 and towards an opposing movable contact 100. FIGS. 5, 6, and 7 illustrate one of moving contacts 100 in detail. Each moving contact 100 includes two end portions 102, having longitudinal axis a, and a central portion 104, having longitudinal axis b. The angle $\alpha$ between axis a and axis b is preferably in the range of 30°–50° inclusive, more preferably in the range of 35°–45°, and is 37° in the preferred embodiment. This angle defined between end portions 102 and central portion 104 permits contacts 100 to be placed in contact carrier 26 with the pairs of movable contacts 100 in substantially the same plane P and with end portions 102 in different quadrants of housing 20 while avoiding crossing of movable contacts 100 as illustrated in FIGS. 2 and 3. The separation of end portions 102 of a pair of movable contacts 100 pair with respect to end portions 102 of the other of movable contacts 100 pair afforded by the angled end portions 102 permits an adequate stroke of movement by end portions 102 with respect to fixed contacts 22 and 23. Also, it can be seen that this configuration reduces the radial dimension of the space required by movable contacts 100 while still providing a relatively long movable contact to create the requisite attractive force as described in detail below.

As illustrated in FIGS. 5 and 7, each movable contact 100 has contact projection 106 formed on respective end portions 102. Also, end portions 102 have tapered edges 108 defined thereon (see FIG. 3 also) defining sacrificial material which serves the purpose of providing material to burn off during arcing caused by current breaking. The geometry of the current path achieved by groove 60 in fixed contacts 22/23 described below pushes the seat of the arc to tapered edges 108. This way the main contact area does not burn up. This configuration facilitates making and breaking electrical contact with fixed contacts 22/23 in the manner described below. Note that tapered edges 108 do not touch fixed contacts 22/23.

Figure 8:
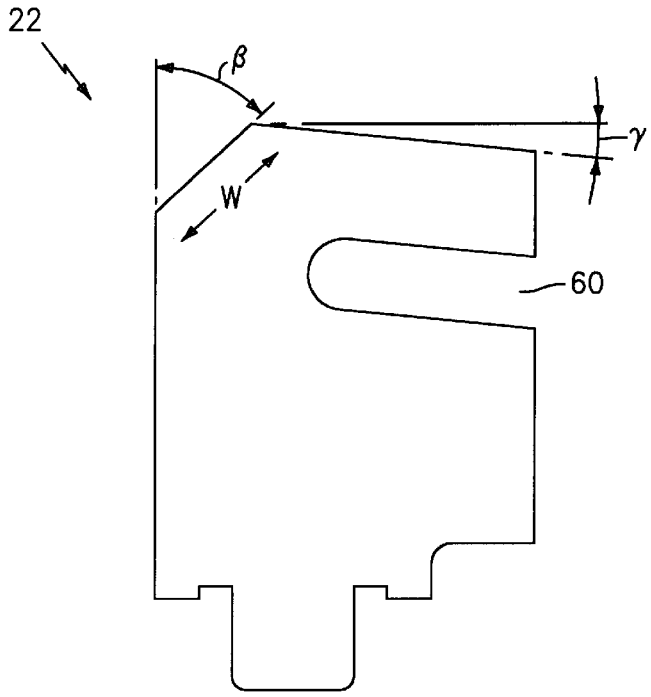
FIG. 8 is a side view of one type of fixed contact of the preferred embodiment.
Figure 9:
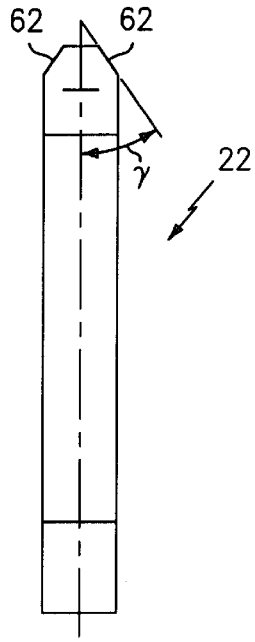
FIG. 9 is an end view of the fixed contact of FIG. 8.
Figure 10:
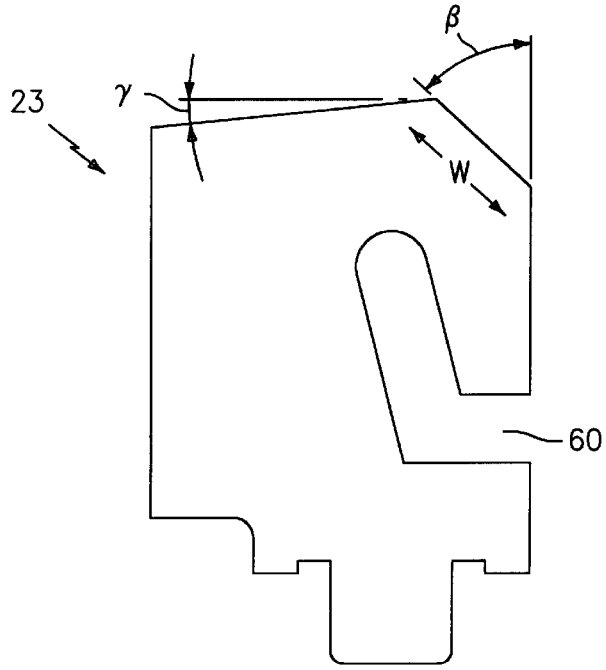
FIG. 10 is a side view of another type of fixed contact of the preferred embodiment.
Figure 11:
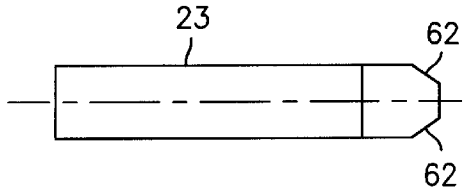
FIG. 11 is a top view of the fixed contact of FIG. 10.

FIGS. 8 and 9 illustrate one of fixed contacts 22 in detail and FIGS. 10 and 11 illustrate one of fixed contacts 23 in detail. The primary difference between fixed contacts 22 and fixed contacts 23 is the shape and orientations of groove 60 formed therein. The different groove shape in fixed contacts 22/23 ensures that the geometry of the current path at all 4 breaks is similar. Technically, the groove 60 is generated to get a "Bend-Back" effect, because the arc generated while breaking is pushed away from the point of break thereby minimizing the roughness caused by arcing at the point of the break (which is also the point of engagement at the time of making). This allows easy movement of movable contacts 100 during further engagement. Other aspects of fixed contacts 22 and 23 are similar and thus these elements will be discussed together with reference to FIGS. 8–11 in which similar elements are labeled with like reference numerals.

Each fixed contact 22/23 is a substantially rectangular plate-like member having a corner removed to define a width w along which contact projection 106 moves as contact carrier 26 is rotated. Angle $\beta$ preferably is about 40°–50° inclusive and is about 47° in the preferred embodiment. An edge of fixed contact 22/23 is chamfered to define sloped receiving surfaces 62 on either side of the edge of fixed contact 22/23 to facilitate making and breaking with movable contacts 100 as described below. The chamfered edge defines angle γ (see FIG. 9) that is preferably less than 10°, 4° in the preferred embodiment.

Figure 12:
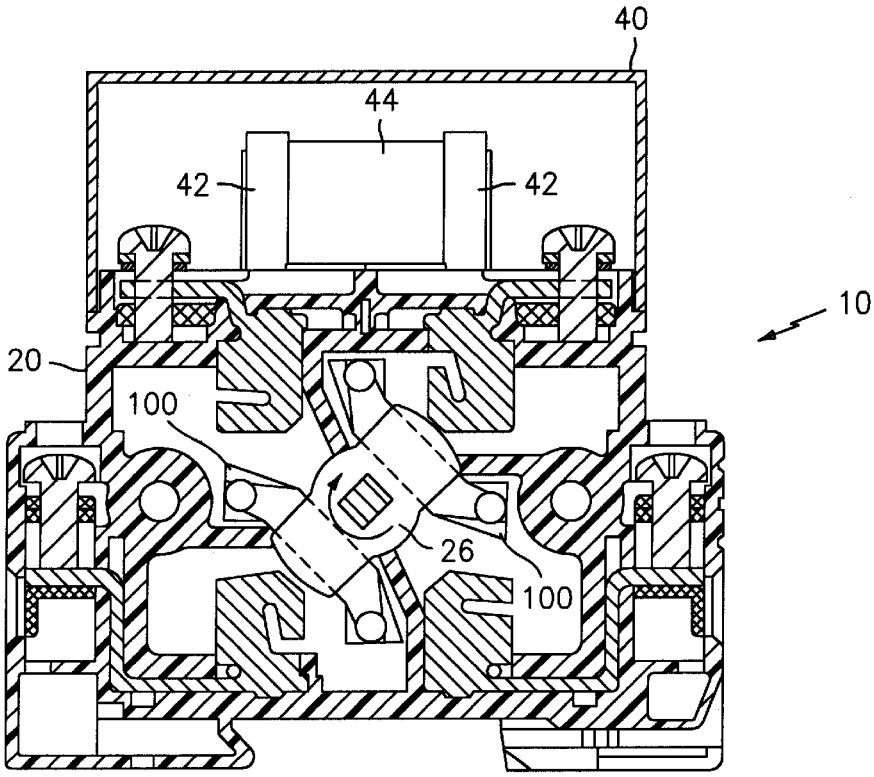
FIG. 12 is a sectional view taken along line 2—2 in FIG. 1 with the movable contacts fully removed from the fixed contacts, i.e., in the "off" position.
Figure 13:
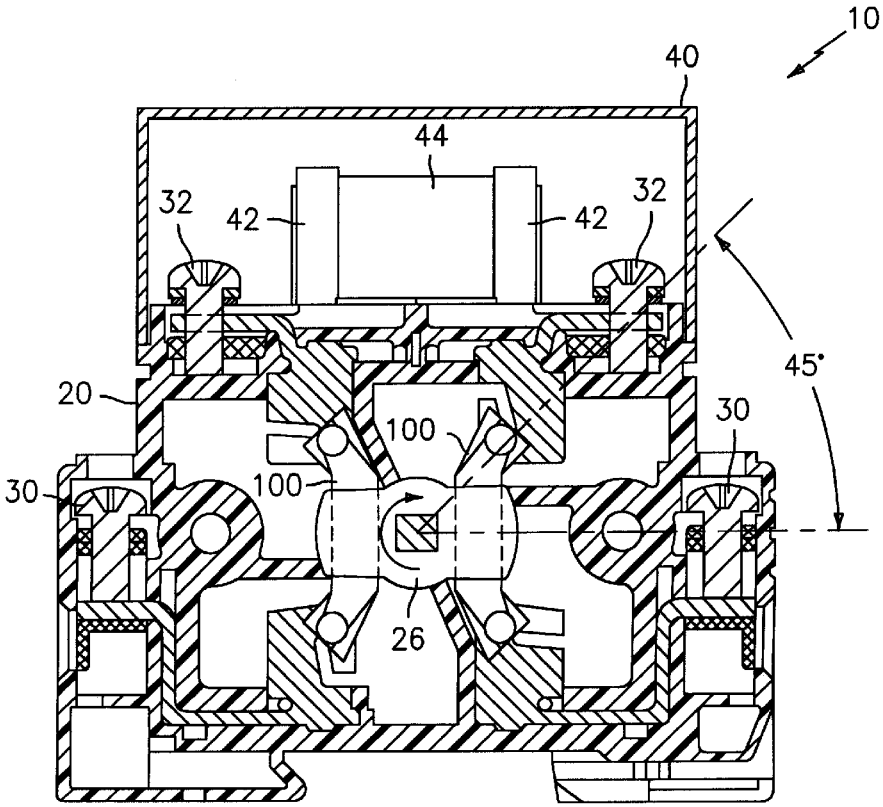
FIG. 13 is a sectional view taken along line 2—2 in FIG. 1 with the movable contacts fully mated with the fixed contacts, i.e. in the "on" position.

As best illustrated in FIGS. 2, 12, and 13, rotation of shaft 28 causes contact carrier 26 to rotate. Accordingly, end portions 102 of movable contacts 100 move toward and away from corresponding fixed contacts 22/23. In particular, when movable contacts 100 are in the fully "off" condition illustrated in FIG. 12, no current flows between fixed contacts 22/23. However, when shaft 28 is rotated clockwise in the drawing, end portions 102 of movable contacts 100 move towards fixed contacts 22/23. When movable contacts 100 reach the position of FIG. 2, contact projection 106 of movable contact 100 slidingly engages the receiving surfaces 62 defined on fixed contacts 22/23. Continued motion of end portions 102 causes the center of contact projection 106 to come in contact and slide along receiving surfaces 62 thus pressing each movable contact 100 away from the opposing movable contact 100 of the pair against the force of spring 24 and the attractive force of movable contacts 100. Keep in mind that as soon as a pair of movable contacts 100 comes into contact with fixed contact 22/23, current is conducted through movable contacts 100 and fixed contacts 22/23 (assuming that a load is applied to terminals 30). Continued rotation in the clockwise direction causes contact projections 106 to pass along width w of fixed contacts 22/23. Similarly, rotation of shaft 28 in the clockwise direction from the position illustrated in FIG. 12, will cause contact projection 106 to move off of and away from fixed contacts 22/23 to break current of the load. It can be seen that end portions 102 travel through about 45° when moving from "off" to "on" or vice versa, within the quadrants defined by partitions 34 of housing 20. A dwell mechanism can be incorporated in switch 10 to quickly move movable contacts 100 over and off of fixed contacts 22 and 23. In other words, once movable contacts 100 pass a dwell point, a large spring force or the like can be used to accelerate movable contacts 100.

As noted above, the angle of end portions 102 with respect to central portions 104 of movable contacts 100 overcomes many of the obstacles to the design of a four-break rotary contact switch. However, this angled configuration also raises other design considerations that must be overcome. In particular, the above-noted attractive and repulsive EMF act in a direction that is perpendicular to the direction of current flow through the contacts. The attractive force due to central portions 104 can be represented as vector Fa1 at the center of central portions 104 directed into the page in FIG. 5. The attractive force due to end portions 102 can be represented as vectors Fa2 at the center of end portions 102 directed into the page in FIG. 5. It can be seen that Fa2 is offset from the longitudinal axis of central portion 104 and thus will cause a moment, i.e. a torque, tending to twist or rotate movable contacts 100 in contact carrier 26 as illustrated by arrows b in FIG. 4.

The repulsive force Fr acts at the point of contact between movable contacts 100 and fixed contacts 22/23 and thus can be represented as vectors Fr at the center of contact projections 106 directed out of the page in FIG. 5. It can be seen that Fr is offset from the longitudinal axis of central portion 104 and thus will cause a moment, i.e. a torque, tending to twist or rotate movable contacts 100 in contact carrier 26 as illustrated by arrows c in FIG. 4. Accordingly, the forces acting on movable contacts 100 are complex and the relative sizes and angles of movable contacts 100 must be designed to account for these forces to avoid popping of the contacts and damage to the switch.

Table 2 below illustrates Examples 1–19 of the various variables and forces which must be balanced to avoid failure of switch 10. Table 1 lists the symbol, units, description and value of the various dimensions of an example of movable contact 100 with symbols correlated to FIGS. 5 and 7.

TABLE 1

| Symbol | Unit | Description | Value |
|---|---|---|---|
| N | No | No. of moving contacts | 2 |
| l1 | m | Length of central portion | 14.8 |
| l2 | mm | Length of end portion (derived) | 5.78 |
| x | mm | Distance between Center points of contact projections | 24 |
| y | mm | Center of bent portion from edge (derived) | 4.25 |
| z | mm | Distance of center points from edge | 6 |
| k | mm | Width of the moving contact | 5 |
| Ar | cm2 | Cross sectional area at contact zone | 0.11 |
| a | mm | Separation between moving contacts in a pair | 3 |
| t | mm | Thickness of moving contact | 1.6 |
| w | mm | Width of fixed contact | 11 |
| Fa | N | Electrodynamic Force of Attraction | |
| Fa1 | N | Attraction force due to length x of movable contact | |
| Fa2 | N | Attraction force due to length y of movable contact | |
| Fr | N | Repulsions force at contact points | |
| Fs | N | Spring force on each movable contact | 10.5 |
| Mr | N-mm | Moment of Fr about edge of movable contact | |
| Ma | N-mm | Moment of Fa about edge of movable contact | |
| Ms | N-mm | Moment of Fs about edge of movable contact | |

Table 2 shows the results of the calculation of the various forces on the contacts for various levels of instantaneous current.

TABLE 2

| Symbol Units | I* kA | Fa1 N | Fa2 N | Ma N-m | Ms N-m | Fr N | Mr N-m | Ma + Ms N-mm |
|---|---|---|---|---|---|---|---|---|
| Ex. 1 | 4 | 0.54 | 0.21 | 3.15 | 89.25 | 2.23 | 26.75 | 92.40 |
| Ex. 2 | 4.5 | 0.68 | 0.27 | 3.98 | 89.25 | 2.76 | 33.14 | 93.23 |
| Ex. 3 | 5 | 0.85 | 0.33 | 4.92 | 89.25 | 3.34 | 40.12 | 94.17 |
| Ex. 4 | 5.5 | 1.02 | 0.40 | 5.95 | 89.25 | 3.97 | 47.68 | 95.20 |
| Ex. 5 | 6 | 1.22 | 0.48 | 7.08 | 89.25 | 4.65 | 55.81 | 96.33 |
| Ex. 6 | 6.5 | 1.43 | 0.56 | 8.31 | 89.25 | 5.37 | 64.48 | 97.56 |
| Ex. 7 | 7 | 1.66 | 0.65 | 9.64 | 89.25 | 6.14 | 73.69 | 98.89 |
| Ex. 8 | 7.5 | 1.90 | 0.74 | 11.07 | 89.25 | 6.95 | 83.43 | 100.32 |
| Ex. 9 | 8 | 2.16 | 0.84 | 12.59 | 89.25 | 7.81 | 93.69 | 101.84 |
| Ex. 10 | 8.5 | 2.44 | 0.95 | 14.21 | 89.25 | 8.70 | 104.45 | 103.46 |
| Ex. 11 | 9 | 2.74 | 1.07 | 15.93 | 89.25 | 9.64 | 115.71 | 105.18 |
| Ex. 12 | 9.5 | 3.05 | 1.19 | 17.75 | 89.25 | 10.62 | 127.46 | 107.00 |
| Ex. 13 | 10 | 3.38 | 1.32 | 19.67 | 89.25 | 11.64 | 139.70 | 108.92 |
| Ex. 14 | 10.5 | 3.73 | 1.46 | 21.69 | 89.25 | 12.70 | 152.40 | 110.94 |
| Ex. 15 | 11 | 4.09 | 1.60 | 23.80 | 89.25 | 13.80 | 165.57 | 113.05 |
| Ex. 16 | 11.5 | 4.47 | 1.75 | 26.20 | 89.25 | 14.93 | 179.20 | 115.27 |
| Ex. 17 | 12 | 4.87 | 1.90 | 28.33 | 89.25 | 16.11 | 193.29 | 117.58 |
| Ex. 18 | 12.5 | 5.28 | 2.06 | 30.74 | 89.25 | 17.32 | 207.82 | 119.99 |
| Ex. 19 | 13 | 5.71 | 2.23 | 33.25 | 89.25 | 18.57 | 222.78 | 122.50 |

*TotaI Instantaneous Current

When the following equation is satisfied, movable contacts 100 will not pop and switch 10 will operate properly:

$$Ma+Ms>Mr$$

where:

Ma is the total moment due to the attractive forces;

Ms is the total moment due to the force of spring 24; and

Mr is the total moment due to the repulsive forces.

In the table, it can be seen that the equation above is satisfied until the instantaneous current through the switch approaches 8.5 kA (Ex. 10). Accordingly, the switch having contacts of the listed dimensions can withstand instantaneous currents of up to almost 8.5 kA which corresponds to accepted ratings for a 63 A switch. Of course the dimensions can be varied to achieve other desired current ratings without contact popping as long as the equation is satisfied. Of course, as the attractive forces overcome the repulsive forces, they will offer resistance to moving contacts 100 sliding over the fixed contacts 22/23, if this passage of high current happens at the time the switch is in the process of being moved to the ON position. This resistance should therefore be overcome by the mechanism that drives the contacts.

Fixed contacts 22/23 and movable contacts 100 can be made of any appropriate electrically conductive material. For example, copper, silver plated copper, aluminum or the like can be used. The above noted forces on the contacts place a high degree of force on the seats of contact carrier 26. Accordingly, contact carrier 26 must be made of a temperature and pressure resistant material. Applicant has found that the material sold under the number TW241F10 and trade name Stanyl by DSM Polymers International is suitable for contact carrier 26. This material has a heat distortion temperature at 1.8 MPa (HDT A) of >290° C. Also, this material has a peak temperature (1 minute) per UL 746 B of >250° C. Applicant has found that use of this material yields a contact carrier that does not distort despite the moments applied to movable contacts 100.

The shape and dimensions of the contacts can be varied based on the mechanical dimensional, and electrical requirements of the switch. Plural sets of movable contact pairs can be mounted on a single shaft to provide a switch of higher capacity or to provide a multi-pole device. Plural sets can also be configured by connections in series or parallel to offer different ratings of current or voltage. The contact pairs or sets can be in the form of modules that can be easily added or removed from the switch. Switches with higher current ratings and lower switching duties can be constructed by using two breaks in parallel instead of four breaks in series. The switch can be fused or non-fused. The movable contacts can be movably mounted in the switch through any appropriate mechanism.

The invention has been described through a preferred embodiment. However, various modifications can be made without departing from the scope of the invention as defined by the appended claims.

What is claimed is:

1. An electric switch comprising:

a housing;

four contacts mounted to said housing;

a rotary member rotatably mounted with respect to said housing; and two pairs of opposing movable contacts, each movable contact having a central portion coupled to said rotary member and having two end portions adapted to contact a corresponding one of said contacts, said pairs of movable contacts being mounted in substantially the same plane.

2. An electric switch as recited in claim 1, wherein said contacts are fixed with respect to said housing.

3. An electric switch as recited in claim 2, wherein a longitudinal axis of each of said end portions defines an angle with respect to a longitudinal axis of said central portion.

4. An electric switch as recited in claim 3, wherein said rotary member comprises a shaft and a contact carrier mounted on said shaft, said center portions being supported by said contact carrier and said end portions extending away from said contact carrier.

5. An electric switch as recited in claim 3 wherein a chamfered edge is defined on said contacts.

6. An electric switch as recited in claim 5, further comprising a projection formed on each of said end portions, said projection being adapted to slide over said chamfered edge when said rotary member is rotated to move said end portions into contact with said contacts.

7. An electric switch as recited in claim 6, wherein tapered edges are formed on said end portions of define sacrificial material.

8. An electric switch as recited in claim 3, wherein said angle is in the range of range of 30°–50° inclusive.

9. An electric switch as recited in claim 3, wherein said angle is in the range of range of 35°–45° inclusive.

10. An electric switch as recited in claim 3, wherein said angle is 37°.

11. An electric switch as recited in claim 4, wherein said contact carrier comprises Stanyl TW241F10.

12. An electric switch as recited in claim 4, further comprising a spring disposed between a surface of said contact carrier and said movable contacts and wherein the dimensions of said movable contacts are set to satisfy the following equation for anticipated instantaneous current levels through the switch;

$$Ma+Ms>Mr$$

where:

Ma is the total moment due to the EMF attractive forces;

Ms is the total moment due to the force of said spring; and

Mr is the total moment due to the EMF repulsive forces.

13. An electric switch comprising:

a housing;

four contacts mounted to said housing; and a rotary member rotatably mounted with respect to said housing; and two pairs of opposing movable contacts, each movable contact having a central portion coupled to said rotary member and having two end portions adapted to contact a corresponding one of said contacts, a longitudinal axis of said end portions extending at an angle with respect to a longitudinal axis of said central portion and said end portions being in substantially the same plane as said central portion.

14. An electric switch as recited in claim 13, wherein said contacts are fixed with respect to said housing.

15. An electric switch as recited in claim 14, wherein said rotary member comprises a shaft and a contact carrier mounted on said shaft, said center portions being supported by said contact carrier and said end portions extending away from said contact carrier.

16. An electric switch as recited in claim 14 wherein a chamfered edge is defined on said contacts.

17. An electric switch as recited in claim 16, further comprising a projection formed on each of said end portions, said projection being adapted to slide over said chamfered edge when said rotary member is rotated to move said end portions into contact with said contacts.

18. An electric switch as recited in claim 17, wherein tapered edges are formed on said end portions to define sacrificial material.

19. An electric switch as recited in claim 14, wherein said angle is in the range of range of 30°–50° inclusive.

20. An electric switch as recited in claim 14, wherein said angle is in the range of range of 35°–45° inclusive.

21. An electric switch as recited in claim 14, wherein said angle is 37°.

22. An electric switch as recited in claim 15, wherein said contact carrier is comprises Stanyl TW241F10.

23. An electric switch as recited in claim 15, further comprising a spring disposed between a surface of said contact carrier and said movable contacts and wherein the dimensions of said movable contacts are set to satisfy the following equation for anticipated instantaneous current levels through the switch;

$$Ma+Ms>Mr$$

where:

Ma is the total moment due to the EMF attractive forces;

Ms is the total moment due to the force of said spring; and

Mr is the total moment due to the EMF repulsive forces.

24. A movable contact for an electric switch of the type having fixed contacts, a rotary member, and at least one pair of the movable contacts mounted on the rotary member said movable contact comprises:

a central portion adapted to be coupled to the rotary member; and two end portions each adapted to define breaks with a corresponding one of said fixed contacts, a longitudinal axis of said end portions extending at an angle with respect to a longitudinal axis of said central portion and said end portions being in substantially the same plane as said central portion.

25. An electric switch as recited in claim 24, wherein tapered edges are formed on said end portions to define sacrificial material.

26. An electric switch as recited in claim 25, further comprising a projection formed on said end portions and being adapted to contact the fixed contacts.

27. An electric switch as recited in claim 24, wherein said angle is in the range of range of 30°–50° inclusive.

28. An electric switch as recited in claim 24, wherein said angle is in the range of range of 35°–45° inclusive.

29. An electric switch as recited in claim 24, wherein said angle is 37°.

30. An electric switch as recited in claim 24, wherein the dimensions of said movable contact are set to satisfy the following equation for anticipated instantaneous current levels through the switch;

$$Ma+Ms>Mr$$

where:

Ma is the total moment due to the EMF attractive forces;

Ms is the total moment due to the force of a spring holding said contact; and

Mr is the total moment due to the EMF repulsive forces.

31. An electric switch comprising:

a housing;

four contacts mounted to said housing;

two movable contact means for selectively electrically coupling said contacts, said movable contact means each comprising an opposing pair of contacts; and rotary means for rotating said movable contact means from a first position where said movable contact means couples said contacts to one another to a second position where said contacts are electrically isolated from one another.

32. An electric switch as recited in claim 31 wherein said movable contact means comprises pairs of parallel movable contacts, each of said pairs being mounted in substantially the same plane.

33. An electric switch as recited in claim 32, wherein said contacts are fixed with respect to said housing.

34. An electric switch as recited in claim 33, wherein a longitudinal axis of end portions of said movable contacts defines an angle with respect to a longitudinal axis of a central portion of said movable contacts.

35. An electric switch as recited in claim 34, wherein said rotary means comprises a shaft and a contact carrier mounted on said shaft, said center portions being supported by said contact carrier and said end portions extending away from said contact carrier.

36. An electric switch as recited in claim 35 wherein a chamfered edge is defined on said contacts.

37. An electric switch as recited in claim 36, wherein tapered edges are formed on said end portions to define sacrificial material.

38. An electric switch as recited in claim 36, further comprising a projection formed on each of said end portions.

39. An electric switch as recited in claim 34, wherein said angle is in the range of range of 30°–50° inclusive.

40. An electric switch as recited in claim 34, wherein said angle is in the range of range of 35°–45° inclusive.

41. An electric switch as recited in claim 34, wherein said angle is 37°.

42. An electric switch as recited in claim 35, wherein said contact carrier comprises Stanyl TW241F10.

43. An electric switch as recited in claim 35, further comprising a spring disposed between a surface of said contact carrier and said movable contacts and wherein the dimensions of said movable contacts are set to satisfy the following equation for anticipated instantaneous current levels through the switch;

$$Ma+Ms>Mr$$

where:

Ma is the total moment due to the EMF attractive forces;

Ms is the total moment due to the force of said spring; and

Mr is the total moment due to the EMF repulsive forces.

44. An electric switch comprising:

a housing;

four contacts mounted to said housing;

two pairs of opposing parallel movable contacts, each of said pairs being mounted in substantially the same plane, each of said movable contacts having a central portion and two end portions adapted to contact said contacts, wherein a longitudinal axis of said end portions defines an angle with respect to a longitudinal axis of said central portion; and a rotary member supporting said pairs of movable for rotating said pairs of movable contacts from a first position, where each end portion of each of said pairs of said movable contacts comes into contact with a side of a respective of said contacts to electrically couple the contacts to one another, to a second position, where said contacts are electrically isolated from one another.

45. An electric switch as recited in claim 44 wherein said contacts are fixed with respect to said housing.

46. An electric switch as recited in claim 44, wherein said rotary member comprises a shaft and a contact carrier mounted on said shaft, said center portions being supported by said contact carrier and said end portions extending away from said contact carrier.

47. An electric switch as recited in claim 44 wherein a chamfered edge is defined on each of said contacts.

48. An electric switch as recited in claim 44, wherein tapered edges are formed on said end portions to define sacrificial material.

49. An electric switch as recited in claim 47, further comprising a projection formed on each of said end portions, said projection coming into contact with one of said contacts when said rotary member is in said first position.

50. An electric switch as recited in claim 44, wherein said angle is in the range of range of 30°–50° inclusive.

51. An electric switch as recited in claim 44, wherein said angle is in the range of range of 35–45° inclusive.

52. An electric switch as recited in claim 44, wherein said angle is 37°.

53. An electric switch as recited in claim 46, wherein said contact carrier comprises Stanyl TW241F10.

54. An electric switch as recited in claim 44, further comprising a spring disposed between a surface of said contact carrier and each of said movable contacts and wherein the dimensions of said movable contacts are set to satisfy the following equation for anticipated instantaneous current levels through the switch;

$$Ma+Ms>Mr$$

where:

Ma is the total moment due to the EMF attractive forces;

Ms is the total moment due to the force of said spring; and

Mr is the total moment due to the EMF repulsive forces.

* * * * *